US006289832B1

(12) United States Patent
Kitamura

(10) Patent No.: US 6,289,832 B1
(45) Date of Patent: Sep. 18, 2001

(54) APPARATUS FOR USE IN SEWING MACHINE FOR DETECTING DAMAGE TO COVERED OR UNCOVERED CONDUCTIVE WIRE

(75) Inventor: Ryota Kitamura, Osaka (JP)

(73) Assignee: Kotobuki Industrial Co, Ltd., Osaka (JP)

( * ) Notice: Subject to any disclaimer, the term of this patent is extended or adjusted under 35 U.S.C. 154(b) by 0 days.

(21) Appl. No.: 09/634,752

(22) Filed: Aug. 9, 2000

(30) Foreign Application Priority Data

Aug. 10, 1999 (JP) ..... 11-226621

(51) Int. Cl.[7] ..... D05B 19/12; D05B 69/36
(52) U.S. Cl. ..... 112/470.01; 112/273
(58) Field of Search ..... 112/470.01, 475.08, 112/475.09, 475.01, 475.02, 273, 278, 2; 343/897

(56) References Cited

U.S. PATENT DOCUMENTS 3,998,173 * 12/1976 Williamson et al. ..... 112/475.08 X
4,703,705 * 11/1987 Wiley ..... 112/475.08

FOREIGN PATENT DOCUMENTS 57-10801 1/1982 (JP) .
3-190080 8/1991 (JP) .

* cited by examiner

*Primary Examiner*—Peter Nerbun
(74) *Attorney, Agent, or Firm*—Knobbe, Martens, Olson & Bear, LLP

(57) ABSTRACT

Disclosed is a damage detection apparatus for use in a sewing machine including a bobbin having a conductive wire wound thereon, and a sewing mechanism having a metal needle, which sews the conductive wire drawn from the bobbin to an object with thread by means of the metal needle. The damage detection apparatus includes a terminal to be electrically connected to part of the conductive wire, and an indicator electrically connected to both of the terminal and the metal needle and arranged to indicate the occurrence of contact of the metal needle with the conductive wire.

10 Claims, 4 Drawing Sheets

APPARATUS FOR USE IN SEWING MACHINE FOR DETECTING DAMAGE TO COVERED OR UNCOVERED CONDUCTIVE WIRE

TECHNICAL FIELD

The present invention relates to an apparatus for use in a sewing machine for detecting damage to a covered or uncovered conductive wire. More specifically, the present invention relates to an apparatus for detecting contact of a needle of a sewing machine with a covered or uncovered conductive wire directly or through the covering material, while sewing the wire to an object or article (e.g., a sheet-like material such as a metal foil) with a sewing machine.

As used herein, the term "conductive wire" in "covered conductive wire" and "uncovered conductive wire" includes all linear conductive materials.

BACKGROUND ART

When a covered or uncovered conductive wire is being sewn to an object with embroidery thread by using a sewing machine, it sometimes happens that, owing to some abnormality such as malfunction of the machine, etc., a needle of the sewing machine comes into contact with the conductive wire directly or through the covering material, thereby damaging the conductive wire. The damage leads to insulation failure, conduction failure, breaking or like failures of the covered or uncovered wire. The damaged wire has little or no commercial value.

No apparatus has so far been developed which warns the operator of the damage to a covered or uncovered conductive wire caused by contact with a needle of a sewing machine. Accordingly, the covered or uncovered conductive wire is conventionally inspected for defects after having been sewn to an object or article. Specifically stated, the wire sewn to the object is tested with a conductivity tester for conduction failure, breaking or like failures, and, in the case of a covered conductive wire, visually checked for insulation failure (flaws on the covering material). When the conductive wire to be sewn is a heating wire, defects can be detected by inspecting the wire for anomalous local heat generation. The above inspection methods, however, are troublesome and often fall to detect conduction failure, breaking or insulation failure. The change of detection is particularly low in the inspection of stranded wires which are comprised of a plurality of fine wires.

SUMMARY OF THE INVENTION

An object of the present invention is to provide an apparatus for detecting contact of a needle of a sewing machine with a covered or uncovered conductive wire, while sewing the wire to an object or article with a sewing machine.

The present invention provides a damage detection apparatus for use in a sewing machine comprising a bobbin having a conductive wire wound thereon and a sewing mechanism including a metal needle, which sews the conductive wire drawn from the bobbin to an object with a thread by means of the metal needle, the apparatus comprising: a terminal to be electrically connected to part of the conductive wire, and an indicator electrically connected to both of the terminal and the metal needle and arranged to indicate the occurrence of contact of the metal needle with the conductive wire.

The apparatus may further comprise: a hollow conductive sleeve having a first longitudinal bore and fitted in a second longitudinal bore provided to the bobbin, and a conductive axle inserted through the first longitudinal bore of the sleeve and rotatably supporting the sleeve and electrically connected to the sleeve, wherein the terminal is provided on the conductive sleeve and is electrically connected to the indicator through the conductive sleeve and the conductive axle.

The apparatus may further comprise an operation control unit that stops the operation of the sewing machine upon occurrence of contact of the metal needle with the conductive wire.

The term "sewing machine" as used herein includes zigzag sawing machines that form zigzag stitches, automatic sewing machines and like sewing devices.

According to the present invention, when a covered or uncovered conductive wire is being sewn to an object or article with the sewing machine, the indicator does not operate while the sewing machine works normally, i.e., while the needle is not in contact with the conductive wire, either directly or through the covering material.

When the needle of the sewing machine comes into contact with the conductive wire directly or through the covering material owing to some abnormality, the circuit associated with the indicator is closed via a terminal connected to the conductive wire and the metal needle of the sewing machine, whereby the indicator operates.

In the above manner, the apparatus of the invention can detect and indicate contact of the needle of the sewing machine with the conductive wire, while sewing the wire to the object or article with the sewing machine.

According to the present invention, damage to a conductive wire caused by contact with a needle can be detected from the reading on the indicator. Further, the damage can be detected in real time, so that suitable measures can be taken more efficiently than in detection by inspection after sewing. That is, when damage to the conductive wire is detected in real time, the damaged portion of the wire can be easily located so that the damage inducing factor can be immediately checked to take preventive actions. For example, if irreparable damage such as breaking is caused to the conductive wire during sewing, a proper measure, for example, the interruption of the sewing operation, can be carried out before the sewing of the wire is complete. This prevents a situation such that the whole length of the wire is sewn to the object or article despite occurrence of damage and the finished product has to be discarded, thereby diminishing the loss of materials and reducing costs.

The apparatus of the present invention can be so constructed as to transmit a signal to the control system of the sewing machine to automatically stop the sewing machine upon closure of the circuit of the indicator, i.e., upon contact of the needle with the conductive wire. The automatic control of the sewing machine is particularly advantageous for use in a multi-head sewing machine that performs simultaneous sewing of a plurality of objects. That is, when the wire is damaged, the head causing the damage can be identified in real time, from the circuit action of the indicator. It is possible to stop only the head causing the damage while continuing operation of the other heads, to thereby minimize the work loss of the multi-head sewing machine as a whole and improve the throughput.

DETAILED DESCRIPTION OF THE PREFERRED EMBODIMENTS

Preferred embodiments of the present invention are described below with reference to the drawings.

Figure 1:
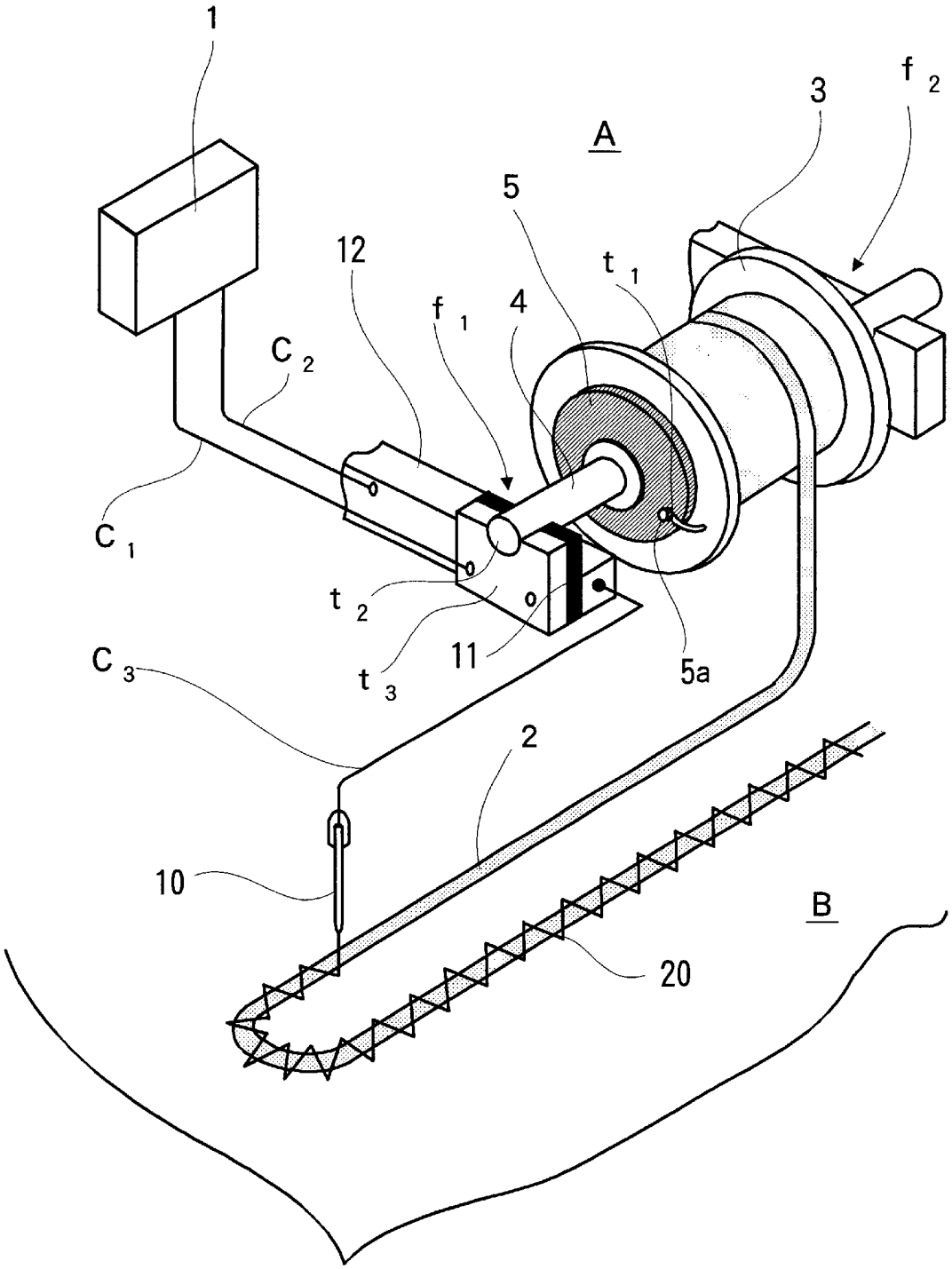
FIG.1 is a perspective view of an embodiment of the damage detection apparatus according to the present invention.

FIG. 1 shows an embodiment of the apparatus for detecting damage to a conductive wire, more specifically, the apparatus for use in a sewing machine for detecting damage to a covered conductive wire during sewing of the wire (hereinafter referred to simply as "damage detection apparatus"). In FIG. 1, A indicates the entire damage detection apparatus. In FIG. 1, only parts of bobbin support frames $f_1$ and $f_2$, a bobbin 3 supported on the frames $f_1$ and $f_2$, and a needle 10 are shown, with other parts of the sewing machine omitted.

The damage detection apparatus A shown in FIG. 1 includes an indicator 1. The indicator 1 may comprise a CRT display device, an LCD (liquid crystal display device), an LED (light emitting diode) display device, a plasma display device, or any of various other indicator means.

A bobbin 3 having a covered conductive wire 2 wound thereon for use in a sewing machine is provided with a conductive sleeve 5 and a conductive axle 4. Furthermore, the damage detection apparatus A has a first terminal $t_1$ electrically connected to the winding starting end portion of the covered conductive wire 2 on the bobbin 3 and a second terminal $t_2$ disposed outward of the bobbin 3 and electrically connected to the terminal $t_1$. A screw portion 5*a* provided on a flange surface of the sleeve 5 can be utilized as the first terminal $t_1$. A projecting portion of the axle 4 out of the bobbin 3 (for example, an end portion of the axle 4) can be utilized as the second terminal $t_2$.

Figure 2:
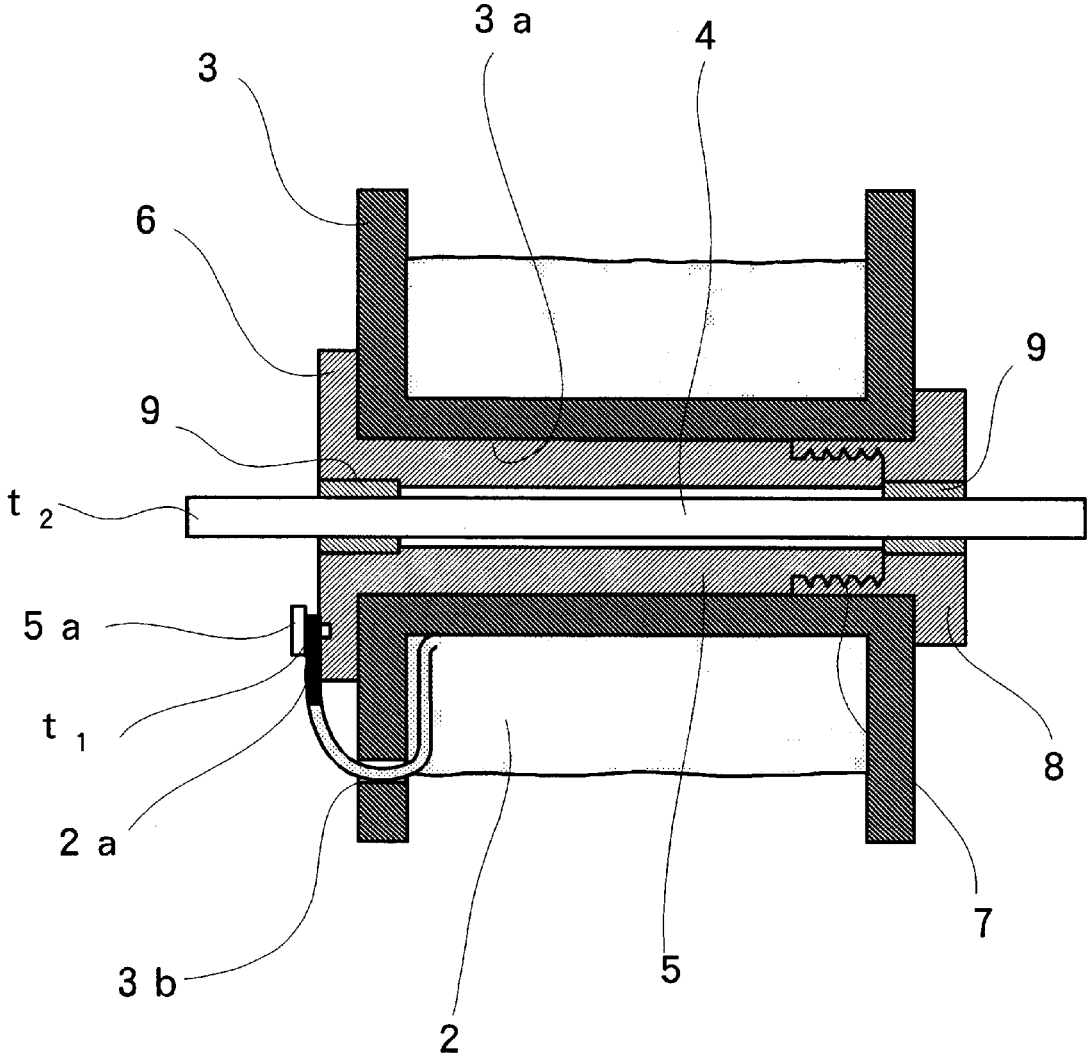
FIG. 2 is a vertical sectional view of the bobbin shown in FIG. 1.

FIG. 2 is a sectional view of the bobbin 3 provided with the sleeve 5 and the axle 4. The conductive sleeve 5 has one end provided with a flange 6 larger in diameter than the hole (longitudinal bore) 3*a* of the bobbin 3 and the other end formed with threads 7 for engagement with a nut 8, so that the sleeve 5 is secured to the bobbin 3 as inserted through the hole 3*a*. The axle 4 has two end portions projecting out of the respective ends of the hole 3*a*. It is generally preferred that the axle 4 be a clearance fit in a hole (longitudinal bore) of the sleeve 5. In this embodiment, the axle 4 is supported by conductive metal bearings (preferably needle bearings) 9 fitted at the respective end portions of the sleeve 5. Thus, the axle 4 is so disposed as to maintain electrical contact with the sleeve 5 and to rotatably support the bobbin 3.

The winding starting end portion 2*a* of the conductive wire 2 wound on the bobbin 3 is passed through a hole 3*b* bored in the bobbin 3 and secured to the flange 6 by the screw portion 5*a*, the starting end portion 2*a* being uncovered so as to establish electrical continuity with the sleeve 5.

In such an arrangement, the conductive wire 2 is electrically connected to the sleeve 5 via the screw portion 5*a* (the first terminal $t_1$), and further connected to the end portion (the second terminal $t_2$) of the axle 4 disposed outward of the bobbin 3 via the metal bearings 9 having electrical continuity with the sleeve 5 and the axle 4. In this embodiment, additional metal bearing(s) may be disposed side by side in the hole of the sleeve 5. This increases the contact area of the bearings 9 with the sleeve 5 and the axle 4 and can improve the electrical conductivity therebetween. For the same purpose, a conductive grease may be applied to the contact surfaces.

Figure 3:
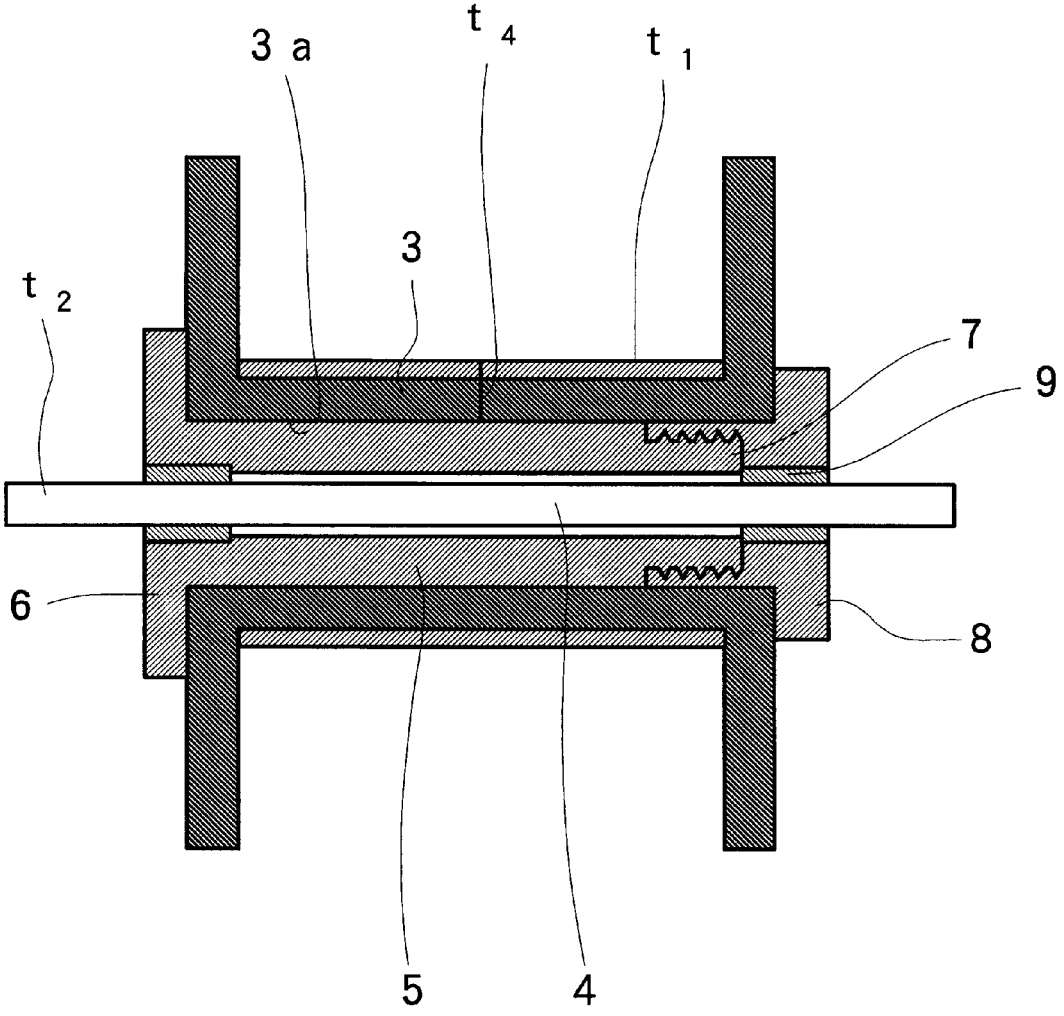
FIG. 3 is a vertical sectional view of another embodiment of the bobbin.

FIG. 3 shows another embodiment of the bobbin 3 without a conductive wire. As shown in FIG. 3, a conductive lining may be formed on the peripheral surface of the body portion of a bobbin 3, and used as a first terminal $t_1$. A conductive axle 4 is disposed through the hole 3*a* of the bobbin 3, with the end portions thereof projecting out of respective ends of the hole 3*a*. One of the end portions of the axle 4 is utilized as a second terminal $t_2$. The axle 4 is electrically connected to the first terminal $t_1$ via a conductive metal bearing 9, a conductive sleeve 5 interposed between the axle 4 and the bobbin 3, and a conductive member $t_4$ piercing through the body portion of the bobbin 3. The conductive member $t_4$ has one end electrically connected to the sleeve 5 and the other end to the first terminal $t_1$. Like the embodiment shown in FIG. 2, the sleeve 5 has one end provided with a flange 6 larger in diameter than the hole 3*a* of the bobbin 3, and the other end formed with threads for engagement with a nut 8, so that the sleeve 5 is secured to the bobbin 3 as inserted through the hole 3*a*. It is generally preferred that the axle 4 be a clearance fit in a hole of the sleeve 5 with conductive metal bearings 9 such as needle bearings, ball bearings or the like.

The winding starting end portion of the covered conductive wire (not shown) is connected to the first terminal $t_1$ in an appropriate manner. For example, the uncovered winding starting end portion of the conductive wire is wound around the cylindrical terminal $t_1$ a suitable number of times, and bonded onto the terminal $t_1$ with an adhesive, as required.

The bobbin 3 having the structure shown in FIG. 2 or 3 is supported or mounted on bobbin support frames $f_1$ and $f_2$ provided on a sewing machine, with the end portions (the second terminal $t_2$) of the axle 4 borne on the support frames $f_1$ and $f_2$.

The frame $f_1$ has a third terminal $t_3$ electrically connected to the second terminal $t_2$ provided on the axle 4 inserted through the bobbin 3. Usable as the third terminal $t_3$ is a metal block formed with a depression for improving physical and electrical contact with the end portion of the axle 4 (the second terminal $t_2$). The third terminal $t_3$ is attached to an arm 12 of the sewing machine main body, with an insulating member 11 intervening therebetween.

The frame $f_2$ is so constructed as to insulate the axle 4 from the sewing machine main body. Insulation is provided by, for example, forming the frame $f_2$ as a whole from an insulating material. Alternatively, the axle 4 can be insulated from the sewing machine main body by the frame $f_2$ having the same structure as the frame $f_1$, an insulating member of the frame $f_2$ being attached to the arm of the sewing machine main body. In this case, it is possible to form a pair of support frames of a symmetric structure.

The indicator 1 has two cable terminals, one of which is connected to the third terminal $t_3$ and the other of which is connected to the metal needle 10 via the frame $f_1$. Preferably, the metal needle 10 is made of or coated with a metal material having high conductivity. Furthermore, a power supply for applying a voltage to the needle 10 and the conductive wire 2 is provided to the indicator 1. In FIG. 1, $C_1$ indicates a cable connecting the one cable terminal with the terminal $t_3$, and $C_2$ indicates a cable connecting the other cable terminal with the needle 10.

In this embodiment, an earth system of the sewing machine main body is utilized to connect the cable terminal of the indicator 1 with the needle 10. Thus, the cable $C_3$ shown in FIG. 1, which extends from the arm 12 of the sewing machine main body to the needle 10, does not exist (i.e., virtually non-existent) in this embodiment. That is, the metal needle 10 is in electrical continuity with a conductive member holding or having the needle 10 (such as a needle holder or a needle bar; hereinafter referred to as "needle holder"), and the needle holder is in electrical continuity with the conductive sewing machine main body. Therefore, if the other cable terminal of the indicator 1 is connected to the arm 12 provided with the frame $f_1$, which Is in electrical continuity with the sewing machine main body, the other cable terminal of the indicator 1 can be electrically connected to the needle 10. With such an arrangement, the damage detection apparatus of the present invention can be realized without altering or modifying sewing head portions of conventional sewing machines.

It is also possible to extend a cable from a needle holder insulated from the sewing machine main body, to the cable terminal of the indicator, without utilizing the earth system. Preferably, a covered conductive cable is used as this cable so as to ensure insulation between the needle 10 and the sewing machine main body. A suitable means is employed to stably connect the covered conductive cable extending to the cable terminal of the indicator, to the needle or needle holder that make up-and-down movements.

During sewing of the covered conductive wire 2 using the sewing machine (sewing thread being indicated as 20 in FIG. 1), the circuit of the indicator 1 is open and thus the indicator 1 does not operate, when the needle 10 performs normal movements, i.e., when the needle 10 is out of contact with the covered conductive wire 2 which is being sewn to an object or article B.

If some abnormality occurs and the needle 10 penetrates through the covering material and comes into contact with the wire 2 as being sewn, the circuit of the indicator 1 is closed via the needle 10, a portion of the wire 2 from the contact point with the needle 10 to the winding starting end on the bobbin 3, the first terminal $t_1$, the second terminal $t_2$ and the third terminal $t_3$. As the result, the indicator 1 operates. Thus, when the needle 10 comes into contact with the wire 2, the indicator can immediately indicate the occurrence of contact.

Figure 4:
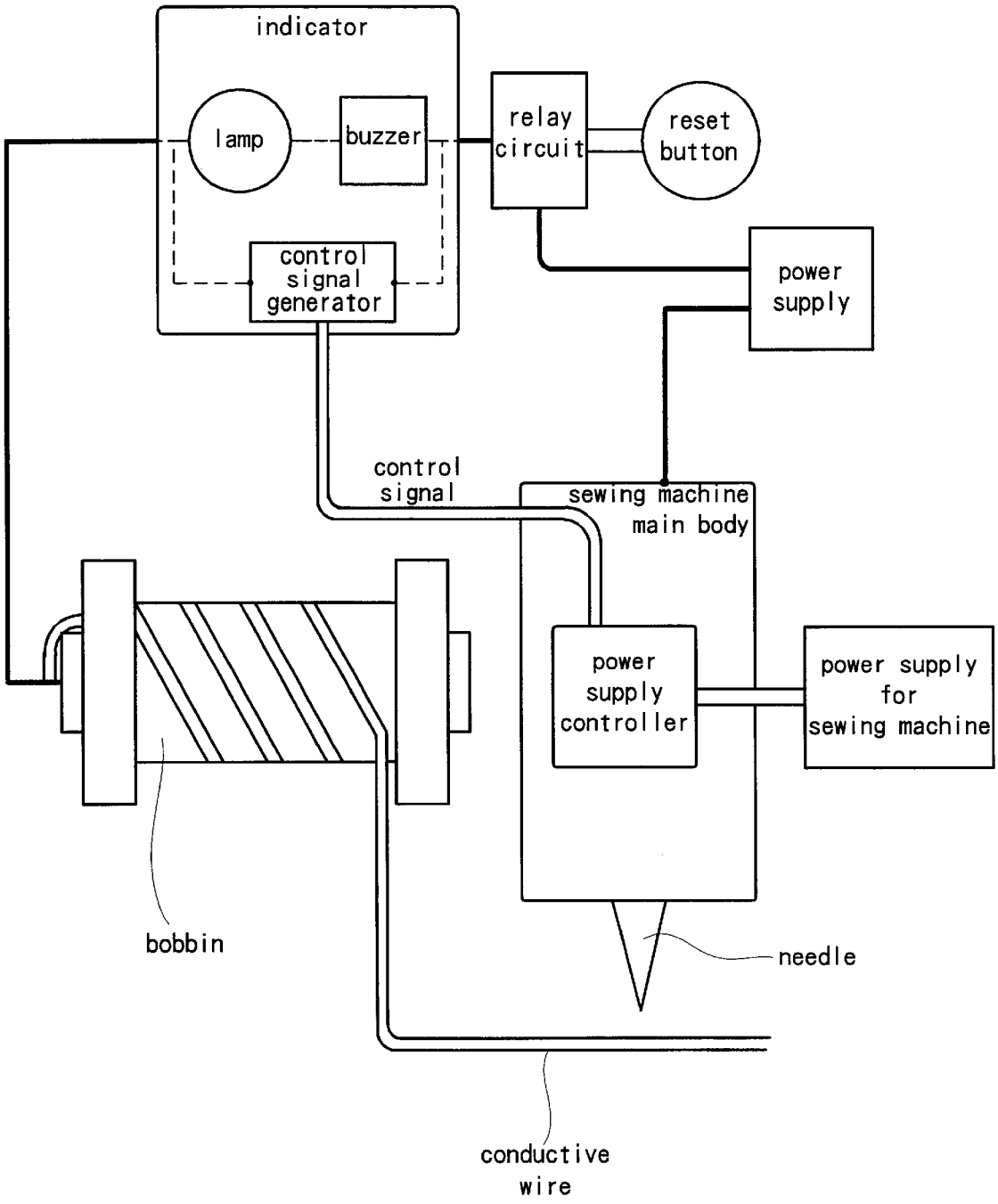
FIG. 4 is a schematic diagram of an automatic stop mechanism for a sewing machine, the mechanism being usable in the damage detection apparatus according to the present invention.

Further, the apparatus can be so constructed as to transmit a signal to the control system of the sewing machine to automatically stop the sewing machine upon closure of the circuit of the indicator. FIG. 4 shows one embodiment of the automatic stop mechanism for sewing machines.

In the embodiment shown in FIG. 4, the damage detection apparatus comprises an operation control unit including a control signal generator which is electrically connected in series with the conductive wire and the metal needle, and a power supply controller which is arranged to receive a control signal from the control signal generator and control the operation of the sewing machine based on the control signal. In this operation control unit, when the needle comes into contact with the conductive wire, the control signal generator generates a control signal and sends it to the power supply controller. Once the power supply controller has received the control signal, it operates to cut off the power supply to the sewing machine. Thus, the operation control unit can stop the operation of the sewing machine upon occurrence of contact of the needle with the conductive wire. In this embodiment, the damage detection apparatus further comprises the reset button and relay circuit associated with the circuit of the indicator so that the sewing machine can be recovered from the halted condition by pushing the reset button.

The apparatus of the invention can be applied to a multi-head sewing machine having a plurality of sewing heads arranged side by side. In a multi-head sewing machine, each sewing head is equipped with the damage detection apparatus A. In this case, the indicator 1 may be provided on each sewing head, or may be an indicator comprising a plurality of indicator means each corresponding to one sewing head (not shown). Further, the automatic stop mechanism can be applied to the multi-head sewing machine. That is, a suitable automatic stop mechanism is provided so that only the head which has come into contact with the needle can be stopped while continuing operation of other heads. With this mechanism, it is possible to minimize the work loss of the multi-head sewing machine as a whole and improve the throughput. Various known electric circuits can be utilized to attain said automatic stop mechanism for sewing machines.

Although the above is an embodiment of a damage detection apparatus for use in a sewing machine that sews the covered conductive wire 2 to the object or article B, the damage detection apparatus of the present invention can be applied to a sewing machine that sews an uncovered conducive wire to an object or article. In this case, a suitable wire feed path is formed in an apparatus as shown in FIG. 1, for maintaining Insulation between an uncovered conductive wire used in place of the covered conductive wire 2 and the sewing machine main body having electric continuity with the needle. For example, insulation can be maintained by using an insulating material for forming a plurality of pulley mechanisms and head units for feeding the wire by a predetermined route to the object or article B. Alternatively, all the portions of the sewing machine that are liable to be brought into contact with the conductive wire may be covered with an insulating material.

Although this embodiment utilizes the earth system of the sewing machine main body as a part of the electrical path to connect the needle 10 to one cable terminal of the indicator 1, it is also possible to insulate the needle holder holding or having the needle 10 from the sewing machine main body and extend a covered cable from the needle holder to connect the needle 10 to the cable terminal of the indicator. With such an arrangement, it is not necessary to insulate the conductive wire 2 from the sewing machine main body, and the conductive wire 2 can be connected to the cable terminal of the indicator via the earth system of the sewing machine main body. In this case, the end portion (the second terminal) of the axle 4 electrically connected to the conductive wire 2 may be directly supported on the bobbin support frame (for example, the arm 12 formed with a depression) serving as a third terminal $t_3$. This eliminates the need for separately forming the third terminal $t_3$ as shown in FIG. 1, which is insulated from the sewing machine main body. This structure can be applicable in sewing of either of the covered conductive wire and the uncovered conductive wire.

Various modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A damage detection apparatus for use in a sewing machine comprising a bobbin having a conductive wire wound thereon and a sewing mechanism including a metal needle, which sews the conductive wire drawn from the bobbin to an object with thread by means of the metal needle, the apparatus comprising:

a terminal to be electrically connected to part of the conductive wire, an indicator electrically connected to the terminal and adapted to be electrically connected to the metal needle, said indicator configured to indicate the occurrence of contact of the metal needle and the conductive wire, a hollow conductive sleeve having a longitudinal bore and adapted to be fitted in a longitudinal bore of the bobbin, and a conductive axle inserted through the longitudinal bore of the sleeve and rotatably supporting the sleeve and electrically connected to the sleeve, wherein the terminal is provided on the conductive sleeve and is electrically connected to the indicator through the conductive sleeve and the conductive axis.

2. The apparatus according to claim 1 further comprising an operation control unit that stops operation of the sewing machine upon the occurrence of contact of the metal needles and the conductive wire.

3. The apparatus according to claim 1, wherein the sleeve comprises a front portion and a rear portion which are fastened in the bobbin, said front portion being inserted into the bore of the bobbin from one end of the bobbin, said rear portion being inserted in the bore of the bobbin from the other end of the bobbin, said front and rear portions being configured to be affixed to the bobbin.

4. The damage detection mechanism according to claim 3, wherein the front portion and the rear portion are fastened with screw threads provided thereto.

5. A damage detection mechanism for use in a sewing machine for sewing to an object a conductive wire drawn from a bobbin with a metal needle, comprising:

a hollow conductive sleeve having a longitudinal bore, said sleeve inserted and fitted in the bobbin wherein a conductive wire wound on the bobbin is electrically in contact with the sleeve;

a conductive axle inserted through the longitudinal bore to rotatably support the sleeve and electrically contact the sleeve;

a terminal electrically contacting the conductive axle; and an indicator electrically connected to both the terminal and the metal needle, said indicator configured to indicate the occurrence of contact of the metal needle with the conductive wire.

6. The damage detection mechanism according to claim 5, wherein the sleeve comprises a front portion and a rear portion which are fastened in the bobbin, said front portion being inserted into the bobbin from one end of the bobbin, said rear portion being inserted in the bobbin from the other end of the bobbin, said front and rear portions being configured to be affixed to the bobbin.

7. The damage detection mechanism according to claim 6, wherein the front portion and the rear portion are fastened with screw threads provided thereto.

8. The damage detection mechanism according to claim 5, further comprising an operation control unit that stops operation of the sewing machine upon the occurrence of contact of the metal needle with the conductive wire.

9. A sewing machine for sewing a conductive wire to an object, comprising:

a bobbin having a conductive wire wound thereon;

a sewing mechanism including a metal needle for sewing with thread the conductive wire drawn from the bobbin to an object; and a damage detection apparatus comprising:

a terminal to be electrically connected to part of the conductive wire, an indicator electrically connected to the terminal and the metal needle and configured to indicate the occurrence of contact of the metal needle and the conductive wire, a hollow conductive sleeve having a longitudinal bore and adapted to be fitted in a longitudinal bore of the bobbin, and a conductive axle inserted through the longitudinal bore of the sleeve and rotatably supporting the sleeve and electrically connected to the sleeve, wherein the terminal is provided on the conductive sleeve and is electrically connected to the indicator through the conductive sleeve and the conductive axis.

10. The sewing machine according to claim 9, wherein said damage detection apparatus further comprises an operation control unit that stops operation of the sewing machine upon the occurrence of contact of the metal needle and the conductive wire.

* * * * *